US006947833B2

(12) United States Patent
Kita et al.

(10) Patent No.: US 6,947,833 B2
(45) Date of Patent: Sep. 20, 2005

(54) ROAD TRAFFIC INFORMATION PROCESSING APPARATUS, ROAD TRAFFIC INFORMATION PROCESSING METHOD, COMPUTER PROGRAM, AND INFORMATION RECORD MEDIUM

(75) Inventors: Daisaku Kita, Saitama (JP); Kenichiro Yano, Saitama (JP); Motoyuki Yamashita, Saitama (JP)

(73) Assignee: Pioneer Corporation, Tokyo (JP)

( * ) Notice: Subject to any disclaimer, the term of this patent is extended or adjusted under 35 U.S.C. 154(b) by 172 days.

(21) Appl. No.: 10/212,055

(22) Filed: Aug. 6, 2002

(65) Prior Publication Data

US 2003/0033078 A1 Feb. 13, 2003

(30) Foreign Application Priority Data

Aug. 8, 2001 (JP) ..... P2001-241353

(51) Int. Cl.[7] ..... G06G 7/76
(52) U.S. Cl. ..... 701/117
(58) Field of Search ..... 701/117, 200, 701/201, 205

(56) References Cited

U.S. PATENT DOCUMENTS 5,933,100 A 8/1999 Golding
6,466,867 B1 * 10/2002 Sakashita ..... 701/211

FOREIGN PATENT DOCUMENTS

WO WO 99/24952 A1 5/1999
WO WO 00/54143 A1 9/2000

OTHER PUBLICATIONS

N.J. Garber: "Traffic and Highway Engineering 2nd edition", 1996, PWS Publishing, USA, XP002251951.

* cited by examiner

*Primary Examiner*—Yonel Beaulieu
(74) *Attorney, Agent, or Firm*—Sughrue Mion, PLLC

(57) ABSTRACT

A road traffic information processing apparatus determines the continuity of road conditions of a traffic jam, control, etc., in a traffic information link (v1, v2) received by road traffic information reception section and the continuity of road conditions of a traffic jam, control, etc., existing in traffic information links of different roads.

9 Claims, 5 Drawing Sheets

ROAD TRAFFIC INFORMATION PROCESSING APPARATUS, ROAD TRAFFIC INFORMATION PROCESSING METHOD, COMPUTER PROGRAM, AND INFORMATION RECORD MEDIUM

BACKGROUND OF THE INVENTION

1. Field of the Invention

This invention relates to a road traffic information processing apparatus installed in a system that can display road conditions, typified by an in-vehicle navigation system, a road traffic information processing method, a program for causing a computer to function as the road traffic information processing apparatus, and an information record medium recording the program.

2. Description of the Related Art

A road traffic information communication system (Vehicle Information Communication System) using FM multiplex telecasting and beacons installed on roads for transmitting and receiving various pieces of road traffic information indicating traffic jam conditions, traffic control conditions, etc., is developed. A road traffic information processing apparatus for serving as a receiver for receiving the road traffic information is installed in most recent in-vehicle navigation systems.

The in-vehicle navigation system contains storage means (storage medium) storing map data made up of a large number of pieces of information such as road data and facility data, and reads the regional map on the periphery of the current position of the vehicle or the regional map of the region to be checked by the user from the storage means, and displays the map on display means implemented as a liquid crystal display, etc.

Further, the in-vehicle navigation system installing a road traffic information processing apparatus can also superpose information indicating the road conditions from time to time on the map for display based on various pieces of road traffic information received, so that the driver can check the road conditions changing every moment while seeing the map.

FIG. 7 schematically shows the principle structure of road data contained in the map data. The road data has the basic configuration of combinations of links and nodes. The link means a line connecting an intersection on a road and another intersection adjacent to that intersection via the road and is given a link number, etc., for management; in FIG. 7, the links are represented as L1, L2, L3 . . . The node is a point connecting two or more links and is given a node number, etc., for management; in FIG. 7, the nodes are represented as N0, N1, N2 . . . Two node information pieces and the link information connecting the nodes make up the above-mentioned basic configuration as one road unit. Further, the road unit contains information called traffic information link aside from the links L1, L2, L3 . . . and is represented as v1 or v2 in FIG. 7.

As seen in the figure, in this example, at least two traffic information links are contained corresponding to one link. The traffic information links are provided corresponding to lanes headed in opposite directions; for example, the traffic information link numbers are given in such a manner that v1 and v2 are given to up and down lanes, respectively, of a main national load or that v1 and v2 are given to inner and outer lanes, respectively, of a two-way belt expressway.

Road traffic information transmitted in the road traffic information communication system is limited to that of the main roads at present, and information concerning all roads is not yet transmitted. Thus, in the above-mentioned map data, the traffic information links are provided only for the road units corresponding to the traffic information transmitted in the road traffic information communication system; for example, no traffic information links are provided for road units corresponding to roads whose traffic information is not transmitted like the road unit containing the link L7 in FIG. 7.

The traffic information transmitted in the road traffic information communication system is made up of at least link number information, traffic information link number information, road condition information, and condition section information. The road condition information contains traffic jam information and control information as condition types so that the traffic conditions of actual roads can be differentiated from each other for recognition. Further, the traffic jam information is classified into information of types responsive to the traffic jam degree such as "heavy traffic jam" and "congestion" and the control information is classified into information of types responsive to the control contents such as "closed to vehicles" and "speed regulation". The condition section information indicating the road section where a traffic jam occurs and the controlled section contains occurrence start position information and occurrence section information of each occurrence section. The occurrence start position information is distance information from the start point in the travel direction of the vehicle in traffic information link; for example, if the distance information indicates 0 meters, the start point of the traffic information link is assumed to be the start position of the occurrence section and if the distance information indicates 200 meters, the point at a distance of 200 meters from the start point of the traffic information link is assumed to be the start position of the occurrence section and the traffic jam or control (regulation) continues following the position in the travel direction. The occurrence section information (traffic jam distance, etc.,) of the section where the traffic jam or control occurs is distance information from the start position.

Upon reception of road traffic information by the road traffic information processing apparatus installed in an in-vehicle navigation system, the in-vehicle navigation system superposes arrows generated based on the road condition information and the condition section information on the map along the road displayed based on the road data contained in the map data for display, as shown in FIG. 8. In the example in the figure, the road traffic information processing apparatus receives the road condition information indicating a heavy traffic jam concerning traffic information link v1 of link L2, traffic information link v1 of link L4, and traffic information link v1 of link L10, receives the road condition information indicating congestion concerning traffic information link v1 of link L3, and further receives the road condition information indicating control concerning traffic information link v2 of link L10; the arrows are displayed in response to the road condition information and the condition section information in the information. In the figure, for convenience of the description, the links, the traffic information links, and the nodes are represented by dashed lines, but only roads and arrows represented by solid lines are displayed on display means of an actual navigation system.

In the example, in the heavy traffic condition concerning the road indicated by link L2 and the congestion condition concerning the road indicated by link L3, a heavy traffic jam or congestion does not occur in all area and occurs from the point at a predetermined distance relative to each forward intersection.

As seen in the figure, a current position mark P indicating the current position of the vehicle is displayed on the road map, whereby approach to a traffic jam section or a control section or the like can be checked in comparison with the position of the vehicle. The current position of the vehicle can be provided by a known current position detection apparatus made up of a GPS receiver, a gyro sensor, a vehicle speed pulse detector, etc.

The in-vehicle navigation system has a function of calculating the route to the destination set by the user and aiding in guiding the vehicle along the determined route. For example, it is made possible to produce voice output such that "turn to right at XX intersection meters ahead" for prompting the driver to make a turn at the intersection. Further, the in-vehicle navigation system installing a traffic information receiver has a function of notifying the driver of the conditions and the section if traffic jam information or control information exists on the route along which the vehicle is guided upon reception of road traffic information. For example, the in-vehicle navigation system produces voice output such that "XX-kilometer traffic jam occurs ahead."

The notifying function faithfully informs the driver of the received road traffic information about the first encountered traffic jam or control when the vehicle runs along the route. For example, in FIG. 8, it is assumed that a route passing through links L1, L2, L3, and L4 in order is set as the route to the destination. A notification based on the traffic information link v1 of the link L2 is made at a predetermined timing when the vehicle runs on the link L1. The vehicle further moves and a notification based on the traffic information link v1 of the link L3 is made at a predetermined timing when the vehicle runs on the link L2. Likewise, a notification based on the traffic information link v1 of the link L4 is made at a predetermined timing when the vehicle runs on the link L3.

Thus, to faithfully inform the driver of the received road traffic information, the driver is notified of the information for each traffic information link at each corresponding timing.

On the other hand, if the driver visually checks these information pieces through the display means of the in-vehicle navigation system, even if the traffic jams are separate, the drive may recognize the traffic jam as a visually continuous traffic jam to no small extent. That is, in the example, as the visually checked sections, the road traffic information concerning the traffic information links of the links L2, L3, and L4 is recognized as a continuous heavy traffic jam or congestion. However, only the notification based on the traffic information link of the link L2 is made from the voice output as described above and consequently the user may recognize the visually checked information and the information provided from the voice output as different information.

SUMMARY OF THE INVENTION

To solve the above-described problem, according to the invention, there is provided a road traffic information processing apparatus including a reception section which receives road traffic information for each unit section, and a determination section which determines continuity of road conditions in the unit section based on the road traffic information received by the reception section.

To solve the above-described problem, according to the invention, there is provided a road traffic information processing apparatus including a reception section which receives road traffic information for each unit section, and a determination section which determines continuity of road conditions in the contiguous unit sections based on the road traffic information concerning a plurality of unit sections, received by the reception section.

To solve the above-described problem, according to the invention, there is provided a road traffic information processing method including a reception step of receiving road traffic information for each unit section, and a determination step of determining continuity of road conditions in the unit section based on the road traffic information for each unit section, received in the reception step.

Further, to solve the above-described problem, according to the invention, there is provided a road traffic information processing method including a reception step of receiving road traffic information for each unit section, and a determination step of determining continuity of road conditions in the contiguous unit sections based on the road traffic information concerning a plurality of unit sections, received in the reception step.

To solve the above-described problem, a computer program of the invention causes a computer to function as each road traffic information processing apparatus described above.

To solve the above-described problem, a record medium of the invention is a computer-readable record medium recording a computer program for causing a computer to function as each road traffic information processing apparatus described above.

DETAILED DESCRIPTION OF THE PRESENT INVENTION

Referring now to the accompanying drawings, there is shown a preferred embodiment of the invention.

First, the configuration of a road traffic information processing apparatus of an embodiment will be discussed with reference to FIGS. 1 to 6.

Figure 1:
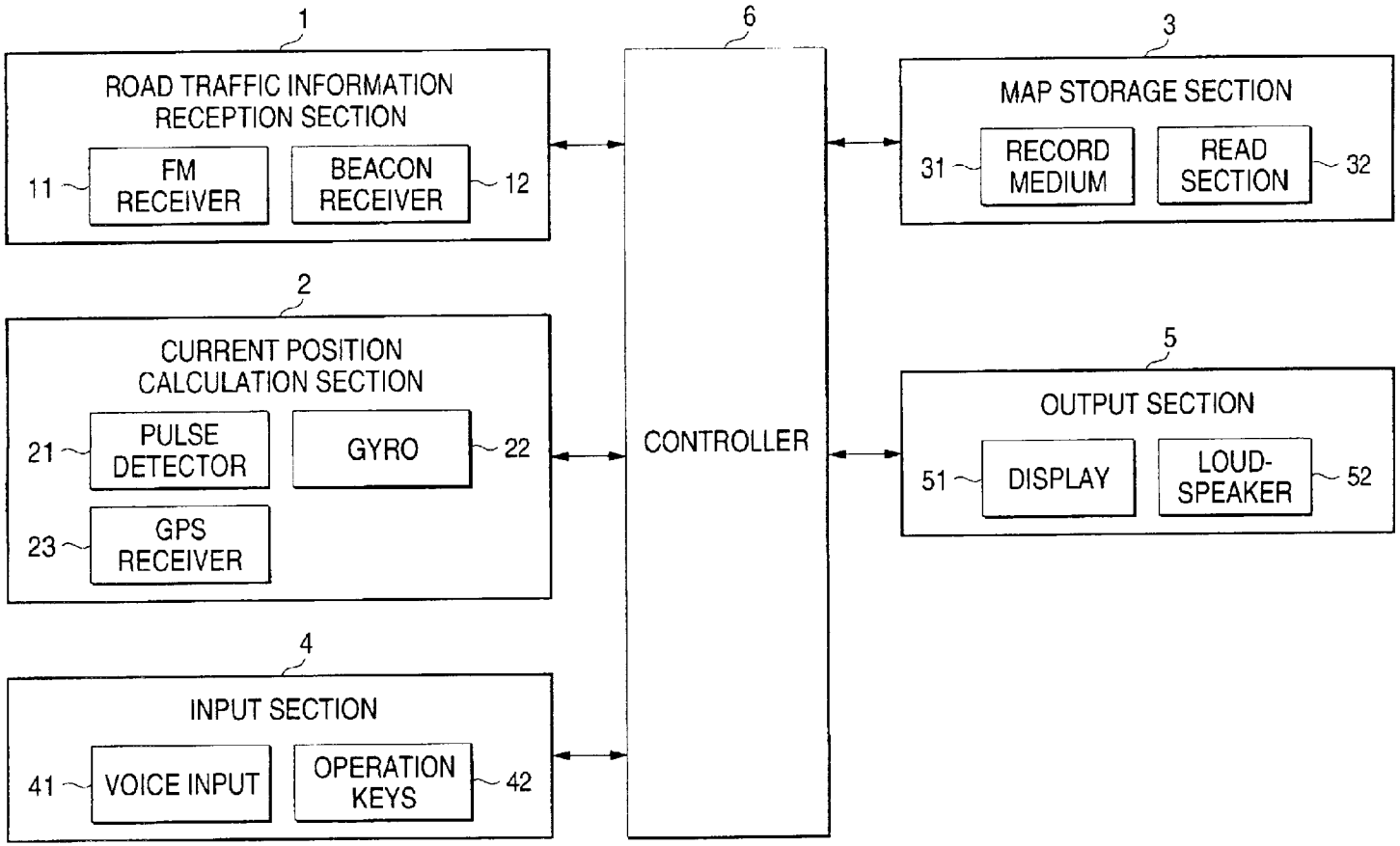
FIG. 1 is a block diagram of a road traffic information processing apparatus as a preferred embodiment of the invention.

FIG. 1 is a block diagram of an in-vehicle navigation system installing the road traffic information processing apparatus. In the figure, numeral 1 denotes road traffic information reception section for receiving road traffic information. The road traffic information reception section 1 includes an FM multiplex telecasting receiver 11 and a beacon receiver 12 for receiving information transmitted from beacons installed on roads.

Numeral 2 denotes a current position calculation section, which calculates the current position of the vehicle. The current position calculation section 2 includes a pulse detector 21 and a gyro 22 as an autonomous current position measuring section and a GPS receiver 23 as a current position measuring section using a GPS satellite. The current position calculation section 2 can output the current position precisely in response to circumstances in such a manner that it finally determines and outputs the current position using the two measured positions of the autonomous measured position by the pulse detector 21 and the gyro 22 and the GPS measured position by the GPS receiver 23, that it finally determines and outputs the current position using only the autonomous measured position as the GPS receiver 23 cannot capture the GPS satellite, or that it finally determines and outputs the current position using only the GPS measured position when the detection state of the gyro 22 worsens because of the effect of temperature change.

Numeral 3 denotes a map storage section. The map storage section 3 includes a record medium 31 of a CD-ROM, a DVD-ROM, a hard disk, etc., recording map data made up of a variety of pieces of information such as road data and facility data and a read section 32 for driving the record medium 31 and reading various pieces of information recorded thereon.

Numeral 4 denotes an input section including a voice input section 41 consisting of a voice input microphone and a voice recognition device and operation keys 42 made up of various input buttons, jog, etc. The user can use the input section 4 to scroll the map displayed on a display 51 and enter a scaling factor change command, a destination and passed-through point setting command, a point search command as name search, address search, etc., and the like.

Numeral 5 denotes an output section including the above-mentioned display 51 for displaying a map, facility information, road information, etc., and a loudspeaker 52 for producing various voice (sound) outputs of a warning sound, guide information, guidance information, etc.

Numeral 6 denotes controller for processing various pieces of information output from the above-described sections and controlling the sections and other various means (not shown) contained in the in-vehicle navigation system.

Figure 8:
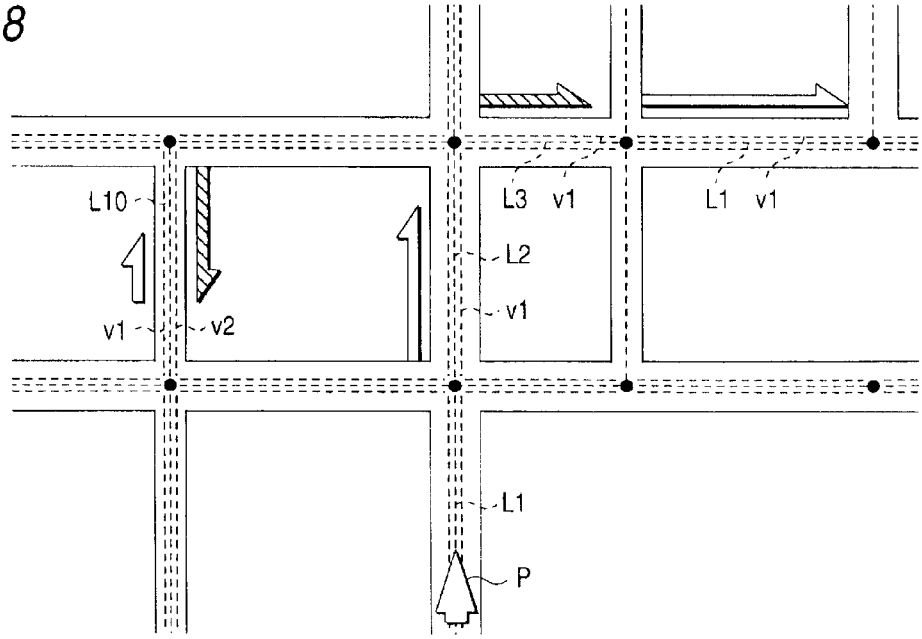
FIG. 8 is a drawing to show the relationship between roads displayed based on map data and arrows displayed based on traffic information.

In the in-vehicle navigation system including the above-described sections, based on the current position provided by the current position calculation section 2, the map data of the current position and its surroundings is read from the record medium 31 by the read section 32 and is displayed on the display 51 together with a current position mark indicating the current position. If the road traffic information concerning the road displayed on the display 51 is acquired through the FM multiplex telecasting receiver 11 and the beacon receiver 12, it is also displayed on the display 51. These points are the same as those of the in-vehicle navigation system in the related art shown in FIG. 8.

FIGS. 2A to 4 are drawings to describe the principle of continuity determination of various conditions of roads such as a heavy traffic jam, congestion, and control in the road traffic information processing apparatus, the feature of the invention.

Figure 2A:
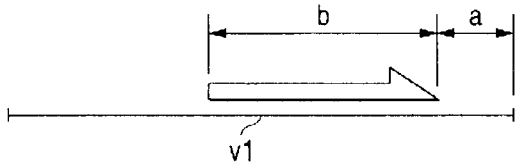
FIGS. 2A to 2C are drawings to describe the principle of continuity determination in the road traffic information processing apparatus as the preferred embodiment of the invention.

FIG. 2A shows an example wherein road condition information indicating "heavy traffic jam" concerning one traffic information link v1 in one road unit is received and an arrow is displayed in the corresponding section based on the condition section information received together with the road condition information. In this case, the condition section information contains a distance a which is from the top of the traffic information link v1 of information to specify the start position of the traffic jam, and a distance b of the occurrence section of information to specify the length of the traffic jam.

To make a continuity determination, first the ratio of the length of the traffic jam (full length) based on the condition section information to the full distance of the traffic information link v1 is calculated. In the example in FIG. 2A, since the length of the traffic jam is less than 50% of the full distance of the traffic information link v1, it is not determined that a continuous traffic jam occurs in the whole section of the traffic information link v1.

Figure 2B:
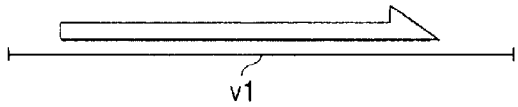

On the other hand, in FIG. 2B, the length of the traffic jam occupies a considerable ratio to the full distance of the traffic information link v1. In this case, in fact, a traffic jam covering the whole section of the traffic information link v1 does not occur, but it is assumed from the ratio that a continuous traffic jam occurs in the whole section of the traffic information link v1.

The ratio of the length of a traffic jam to the full distance of the traffic information link v1 from which it is assumed that a continuous traffic jam occurs in the whole section of the traffic information link v1 maybe determined appropriately in response to the apparatus specifications. For example, if the ratio is set to 80%, the effect of almost matching the visually checked information from the display and the information provided by the voice guide can be provided.

Figure 2C:
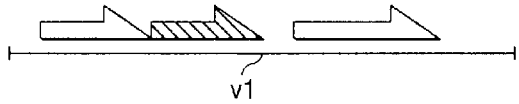

In FIG. 2C, one traffic information link v1 contains two "heavy traffic jams" and one "congestion." In such a case, the total sum distance of the section information of the conditions contained in the traffic information is found and is compared with the full distance of the traffic information link v1. In this case, the total sum distance of the two "heavy traffic jams" and the one "congestion" occupies a considerable ratio to the full distance of the traffic information link v1. In fact, heavy traffic jam and congestion covering the whole section of the traffic information link v1 does not occur, but it is assumed from the ratio that continuous heavy traffic jam and congestion occurs in the whole section of the traffic information link v1.

Figure 3A:
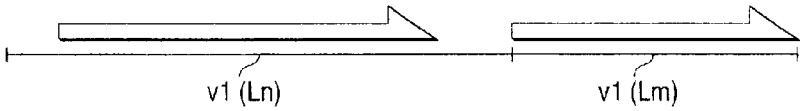
FIGS. 3A and 3B are drawings to describe the principle of continuity determination in the road traffic information processing apparatus as the preferred embodiment of the invention.

FIG. 3A shows an example wherein road condition information indicating "heavy traffic jam" concerning traffic information links v1 related to two contiguous links (Ln) and (Lm) (in the figure, denoted as v1 (Ln) and v1 (Lm)) are received and arrows are displayed in the corresponding section based on the condition section information received together with the road condition information. In the figure, a traffic jam occurs in a part of the traffic information link v1 (Ln) and a traffic jam occurs in the whole of the traffic information link v1 (Lm). In this case, to make a continuity determination, first, as for the traffic information link v1 (Ln), the length of the traffic jam occupies a considerable ratio to the full distance of the traffic information link v1 (Ln). In fact, a traffic jam covering the whole section of the traffic information link v1 (Ln) does not occur, but it is assumed from the ratio that a continuous traffic jam occurs in the whole section of the traffic information link v1 (Ln). As for the traffic information link v1 (Lm), the length of the traffic jam is the same as the full distance of the traffic information link v1 (Lm) and therefore it is assumed that a continuous traffic jam occurs in the whole section of the traffic information link v1 (Lm). Then, it is determined that the traffic jam continues in the whole of the traffic information link v1 (Ln) and the traffic information link v1 (Lm) contiguous to the link v1 (Ln).

Figure 3B:
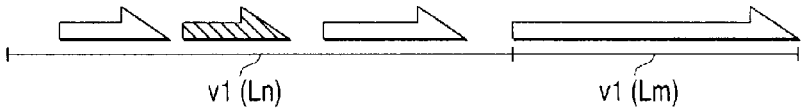

In FIG. 3B, the traffic information link v1 (Ln) contains two "heavy traffic jams" and one "congestion." In this case, it is also assumed that continuous traffic jam and congestion occurs in the whole section of the traffic information link v1 (Ln) as previously described with reference to FIG. 2C. It is determined that the traffic jam continues in the whole of the traffic information link v1 (Ln) and the traffic information link v1 (Lm) contiguous to the link v1 (Ln) as with the case in FIG. 3A.

The ratio from which it is assumed that a continuous traffic jam occurs may be determined appropriately in response to the apparatus specifications.

Figure 4A:
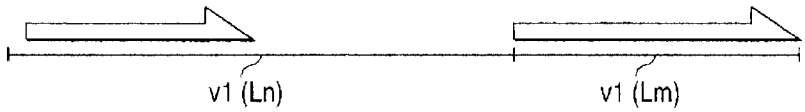
FIGS. 4A to 4B are drawings to describe the principle of continuity determination in the road traffic information processing apparatus as the preferred embodiment of the invention.

FIG. 4A also shows an example wherein road condition information indicating "heavy traffic jam" concerning traffic information links v1 related to two contiguous links (Ln) and (Lm) (in the figure, denoted as v1 (Ln) and v1 (Lm)) are received and arrows are displayed in the corresponding section based on the condition section information received together with the road condition information. In the figure, a traffic jam occurs in a part of the traffic information link v1 (Ln) and a traffic jam occurs in the whole of the traffic information link v1 (Lm). In this case, to make a continuity determination, first, as for the traffic information link v1 (Ln), the length of the traffic jam is less than 50% of the full distance of the traffic information link v1 (Ln) and thus from the ratio, it is not determined that a continuous traffic jam occurs in the whole section of the traffic information link v1 (Ln). The position of the traffic jam is not on the side of the traffic information link v1 (Lm) and therefore it is assumed that the traffic jam is separate from the traffic jam in the traffic information link v1 (Lm).

Figure 4B:
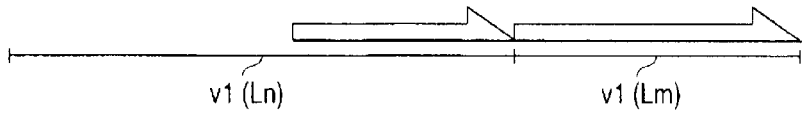

On the other hand, in FIG. 4B, as for the traffic information link v1 (Ln), it is not determined that a continuous traffic jam occurs in the whole section, as in FIG. 4A. However, the position of the traffic jam is on the side of the traffic information link v1 (Lm) and therefore it is assumed that the traffic jam is contiguous to the traffic jam in the traffic information link v1 (Lm).

The ratio from which it is assumed that a continuous traffic jam occurs may be determined appropriately in response to the apparatus specifications.

As shown in FIGS. 3A to 4B, to determine the continuity of the conditions from the traffic information concerning a plurality of traffic information links, not only the continuity for each traffic information link, but also the positions of the conditions (traffic jam, etc.,) are considered.

Figure 5:
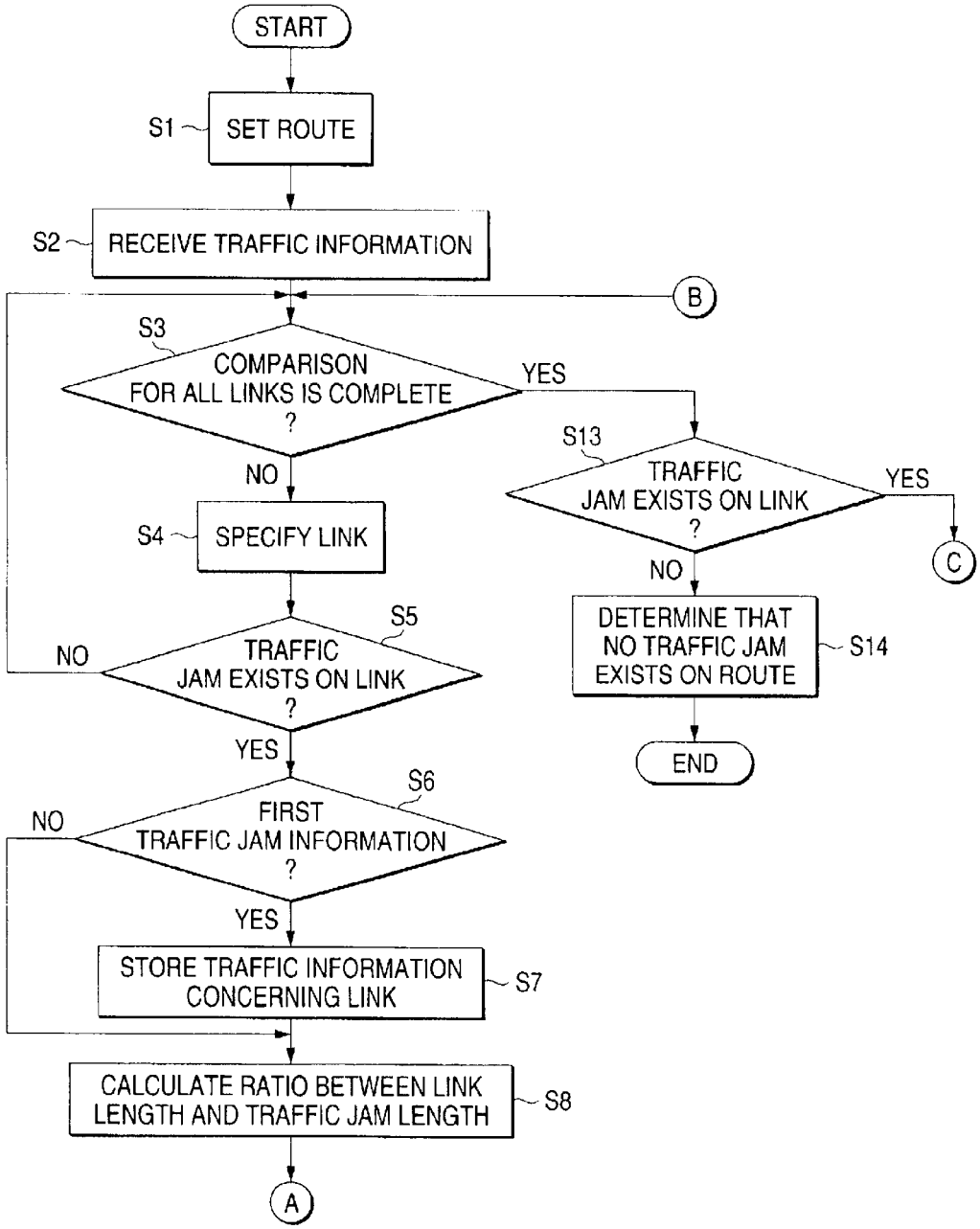
FIG. 5 is an operation flowchart for the continuity determination in the road traffic information processing apparatus as the preferred embodiment of the invention.
Figure 6:
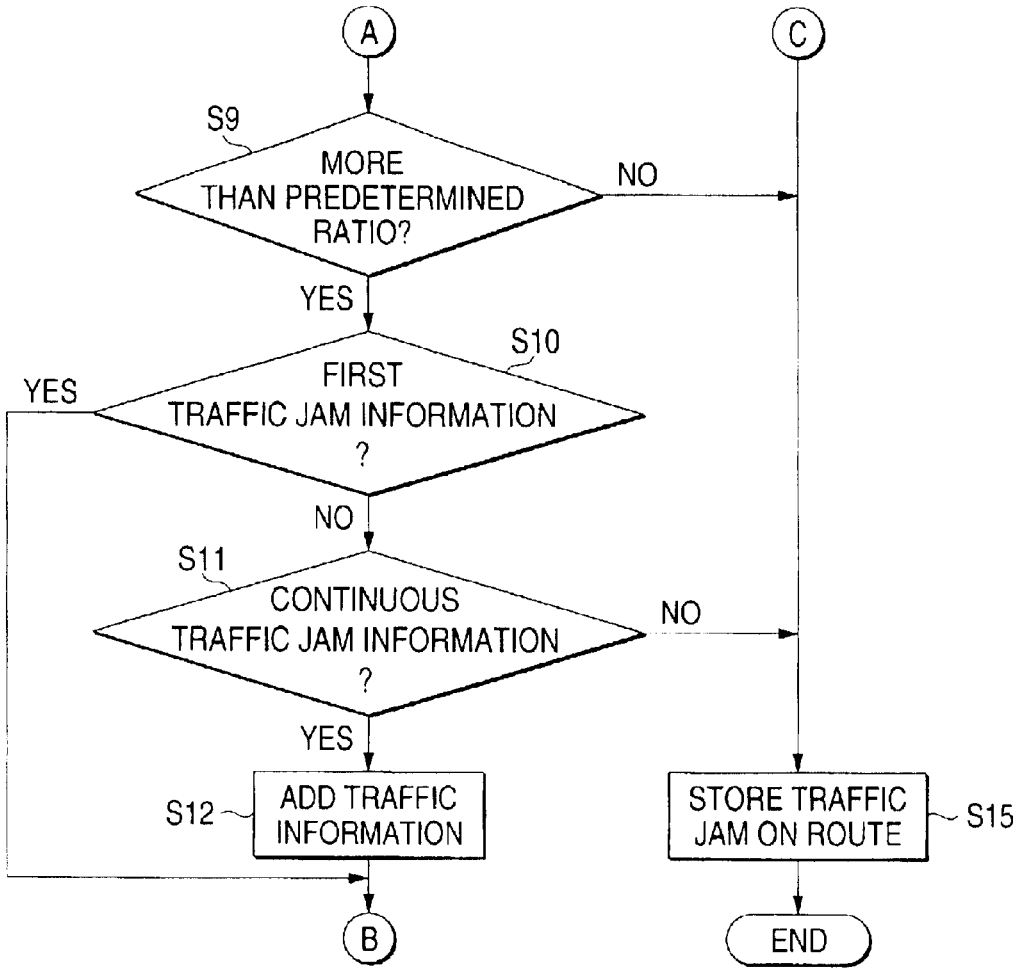
FIG. 6 is an operation flowchart for the continuity determination in the road traffic information processing apparatus as the preferred embodiment of the invention.
Figure 7:
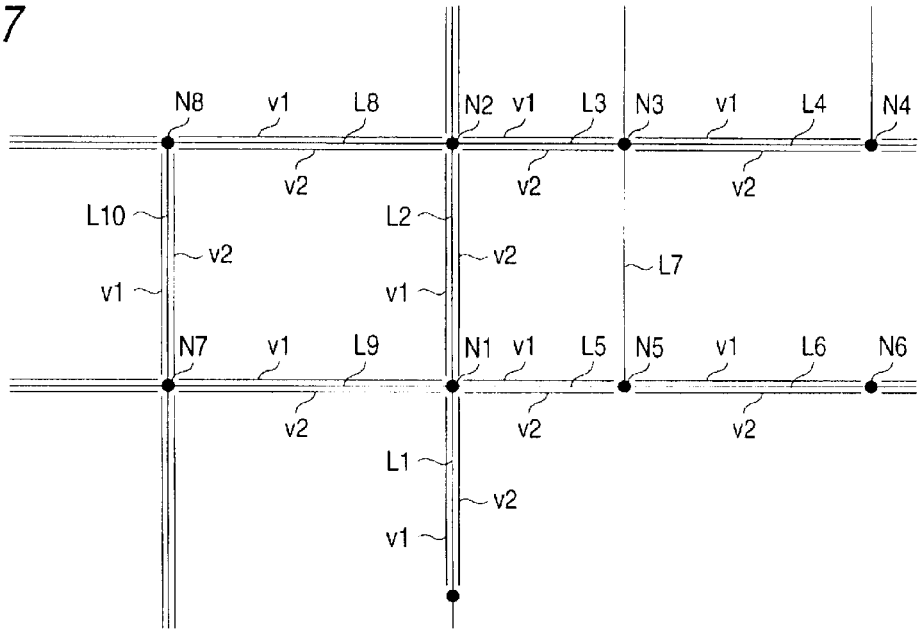
FIG. 7 is a drawing to schematically show the principle structure of road data contained in map data.

Next, FIGS. 5 and 6 are operation flowcharts for continuity determination.

An operation example shown in the figures concerns the operation performed when the user sets a route and then traffic information is received.

To begin with, upon reception of the start point and destination entered by the user through the input section 4, an optimum route is calculated (step S1). Next, traffic information is received by the road traffic information reception section 1 (step S2) and whether or not comparison is complete for all traffic information links of the roads selected on the route is determined (step S3). When the comparison starts, comparison for all traffic information links is not complete and thus NO is returned from step S3 and the traffic information link to be compared with the traffic information is specified (step S4).

Whether or not a traffic jam exists on the traffic information link (in the description that follows, "heavy traffic jam" is taken as an example) is determined (step S5). If it is determined that no traffic jam exists, control goes to step S3 and the process is repeated. On the other hand, if it is determined that a traffic jam exists, whether or not the traffic jam is the first recognized traffic jam on the route after the comparison is started is determined (step S6). If the traffic jam is determined the first one, it is stored (step S7) and then the length of the traffic jam is compared with the length of the traffic information link and the ratio of the length of the traffic jam to the length of the traffic information link is found (step S8).

Whether or not the found ratio is more than a predetermined value is determined (step S9). If YES is returned, whether or not the traffic jam is the first recognized traffic jam on the route after the comparison is started is determined (step S10). If the traffic jam is determined the first one, the process goes to step S3 and again whether or not traffic jam information exists is determined.

If it is determined at step S6 that the traffic jam is not the first recognized traffic jam after the comparison is started, the process goes to step S8 and the ratio between the length of the traffic jam and the length of the traffic information link where the traffic jam exists is calculated. If it is determined at step S9 that the ratio is more than the predetermined value and it is determined at step S10 that the traffic jam is not the first recognized one after the comparison is started, the continuity relationship with the preceding traffic jam is determined (step S11). If it is determined at step S11 that the traffic jams are contiguous, the length of the preceding traffic jam and the length of the current traffic jam are added to find the full length of the traffic jams (step S12).

If it is determined at step S3 that the comparison for all traffic information links is complete, whether or not a traffic jam exists on the traffic information links for which the comparison is complete is determined (step S13). If no traffic jam information exits, it is determined that no traffic jam exists on the route (step S14) and the process sequence is terminated.

If it is determined at step S13 that a traffic jam exists, if it is determined at step S9 that the ratio is more than the predetermined value, or if it is determined at step S11 that the traffic jams are not contiguous, each traffic jam recognized so far is stored and voice guide is conducted based on the stored information.

The flowcharts can cover the traffic information changing from time to time as the process is repeated whenever new traffic information is received.

The flowcharts can be used not only as the traffic jam continuity determination operation, but also as the control continuity determination operation and the traffic jam and control continuity determination operation.

That is, the invention can be applied appropriately to various types of traffic information without departing from the spirit and scope of the invention.

The controller 6 shown in FIG. 1 is implemented as a microcomputer and a program for causing the microcomputer to perform the above-described continuity determination operation is stored on system ROM (not shown) and is executed at a predetermined timing, whereby the microcomputer serves the function as the road traffic information processing apparatus.

The program may be stored on the record medium 31 of the map storage section 3 recording the map data described above rather than in the system ROM and may be read by the read section 32 and temporarily stored in system RAM (not shown) for execution at a predetermined timing.

According to the invention, the contents of traffic information of which the user is notified at the route guide time, etc., can be matched with the contents of traffic information visually provided and understood by the user through the display means.

What is claimed is:

1. A navigation system, comprising:

a receiving circuit that receives road traffic information for a first portion of a route; and a controller that determines continuity of at least one traffic condition for the first portion of the route based on the road traffic information, wherein the controller determines the continuity of the at least one traffic condition by determining a first ratio calculated based on a length of the at least one traffic condition and a length of the first portion of the route.

2. The navigation system as claimed in claim 1, wherein the first ratio is a ratio of the length of the at least one traffic condition to the length of the first portion of the route, and wherein the controller determines that the at least one traffic condition is continuous along the entire first portion of the route when the first ratio is greater than a predetermined number.

3. The navigation system as claimed in claim 2, wherein the controller determines that the at least one traffic condition is not continuous along the entire first portion of the route when the first ratio is less than a predetermined number.

4. A navigation system, comprising: and a receiving circuit that receives road traffic information for a first portion of a route;

a controller that determines continuity of at least one traffic condition for the first portion of the route based on the road traffic information, wherein the at least one traffic condition comprises a plurality of traffic conditions, wherein the controller determines a first length based on the sum of lengths of the plurality of traffic conditions;

wherein the controller determines the continuity of the at least one traffic condition by determining a first ratio calculated based on the first length and a second length of the first portion of the route.

5. The navigation system as claimed in claim 4, wherein the controller determines that the at least one traffic condition is continuous along the entire first portion of the route when the first ratio is greater than a predetermined number.

6. The navigation system as claimed in claim 5, wherein the controller determines that the at least one traffic condition is not continuous along the entire first portion of the route when the first ratio is less than a predetermined number.

7. A navigation system, comprising:

a receiving circuit that receives first road traffic information for a first portion of a route and receives second road traffic information for a second portion of the route, wherein the first portion of the route and the second portion of the route are contiguous; and a controller that determines continuity of at least a first traffic condition for the first portion of the route and at least a second traffic condition for the second portion of the route based on the first road traffic information and the second road traffic information, wherein the controller determines the first traffic condition and the second traffic condition are continuous along the first portion of the route and the second portion of the route when a first ratio of a sum of the lengths of the first traffic condition and the second traffic condition to a sum of the lengths of the first portion and the second portion of the route is greater than a predetermined number.

8. The navigation system as claimed in claim 7, wherein the first traffic condition comprises a first set of traffic conditions, and wherein the second traffic condition comprises a second set of traffic conditions.

9. A navigation system, comprising:

a receiving circuit that receives first road traffic information for a first portion of a route and receives second road traffic information for a second portion of the route, wherein the first portion of the route and the second portion of the route are contiguous; and a controller that determines continuity of at least a first traffic condition for the first portion of the route and at least a second traffic condition for the second portion of the route based on the first road traffic information and the second road traffic information, wherein the controller determines that the first traffic condition is continuous along the entire first portion of the route when a first ratio of a length of the first traffic condition to a length of the first portion of the route is greater than a predetermined number;

wherein, when the first ratio is less than the predetermined number, the controller determines that the first traffic condition and the second traffic condition are a single continuous traffic condition spanning alone both the first portion and the second portion of the route when the first traffic condition and the second traffic condition are contiguous; and wherein, when the first ratio is less than the predetermined number, the controller determines that the first traffic condition and the second traffic condition are not a single continuous traffic condition spanning along both the first portion and the second portion of the route when the first traffic condition and the second traffic condition are not contiguous.

* * * * *